United States Patent [19]

Fox

[11] Patent Number: 4,703,938

[45] Date of Patent: Nov. 3, 1987

[54] SEAL FOR RAM TYPE BLOWOUT PREVENTOR

[76] Inventor: Allan J. Fox, 8314 Hanley, Houston, Tex. 77040

[21] Appl. No.: 828,193

[22] Filed: Feb. 10, 1986

[51] Int. Cl.[4] ..... F16J 15/56; E21B 33/06

[52] U.S. Cl. ..... 277/73; 277/30; 277/103; 277/198

[58] Field of Search ..... 251/1.1, 1.2, 1.3; 277/73, 103, 30, 31, 127, 165, 166, 192, 198, 199, 228, 231, 185

[56] References Cited

U.S. PATENT DOCUMENTS

| | | | |
|---|---|---|---|
| 1,592,249 | 7/1926 | Wyatt | 277/106 X |
| 3,434,729 | 3/1969 | Shaffer et al. | 277/73 X |
| 4,332,367 | 6/1982 | Nelson | 277/192 X |
| 4,398,729 | 8/1983 | Bishop et al. | 277/198 X |
| 4,541,639 | 9/1985 | Williams | 277/73 |

*Primary Examiner*—Robert S. Ward

*Attorney, Agent, or Firm*—Pravel, Gambrell, Hewitt Kimball & Krieger

[57] ABSTRACT

A blowout preventor ram seal having a reversible top seal portion and a reverisble face seal portion wherein the two portions are installed on a ram block and attached to the ram block and to each other.

9 Claims, 2 Drawing Figures

SEAL FOR RAM TYPE BLOWOUT PREVENTOR

BACKGROUND OF THE INVENTION

1. Field of the Invention

The present invention relates to the field of oil field drilling equipment, especially to blowout preventors.

2. Description of the Prior Art

Blowout preventors are necessary to protect the drilling rig, the workers and the environment from possible blowout conditions.

There are two main types of blowout preventors (BOP's), annular and ram. Such BOP's are typically mounted in the wellhead such that the drill pipe extending from the derrick to the bottom of the bore hole also extends through the BOP. Ram type preventors seal the bore by forming a top seal between the movable ram and the BOP housing and a face seal between opposing rams or opposing rams and the intervening drill pipe. The seals are made of a thick rubber capable of handling the required pressures. Today, such seals typically include a face seal section joined with a semi-circular peripheral section known as the top seal. A top seal is used because the high pressure fluids are coming up the well bore and therefore force the rams upward.

It is necessary for the top and face seals to provide a continuous seal around the entire ram and for the seals to be firmly attached to each ram block. In use, it is known that the resilient seals wear out and must be removed from the BOP rams and replaced. In one prior art ram seal the face seal was first inserted into the face of the ram. The top seal was then placed into a groove formed in top of the ram. The two seals were held in place by pins extending from the top seal which mated with face seal and resulted in a locking configuration. This ram seal design had the problem that it would not function if installed upside down because there was only one top seal.

This problem of upside down installation was addressed in another prior art design as illustrated in U.S. Pat. No. 3,434,729. In this design a single piece ram seal was developed that was symmetrical. A ram block floated in the ram, with the top seal being affected by the well pressure. The ram block was essentially a semi-circular cylindrical section, with the ram seal surrounding the perimeter of the ram block. The portion of the ram seal that contacted the circular portion of the block formed the top seal and was split horizontally. This design allowed the ram block to be inserted into the single piece seal by separating the top seal horizontal portions and sliding the ram block through the upper and lower horizontal portions of the ram seal until the ram block contacted the face portion of the seal. The ram seal was held in place on the ram block by the use of two retaining screws mounted through the ram block and mating with trunnion nuts located inside the face portion of the seal. This ram seal design did overcome the upside down problem, but the seal was difficult to install on the ram block because of the thickness and strength of the materials involved. This ram seal also had the problem that both the top and the face seals had to be replaced together. Because the face seal generally wears out much faster than the top seal, top seals having significant usable life were being discarded, increasing the cost of operation.

SUMMARY OF THE INVENTION

The present invention provides a ram seal that is symmetrical and is easy to install. The ram seal of the present invention is an improvement over the prior art symmetrical seal. The ram seal of this invention separates the top and face seal portions of the prior art seal into two pieces, allowing simple installation of the ram seal. The top seal includes tab portions which contact the face of the ram block. There are T-shaped metal elements located in the interior of the tabs and mate with upper and lower portions of the top seal. The metal portions are T-shaped to be retained by the upper and lower portions of the top seal and to provide a surface area to contact the ram block face. The top seal portion is wrapped around the ram block.

The invention further includes a face seal with internal trunnion nuts which is placed on the ram block. The rubber forming the face seal is designed to mate with the tabs of the top seal. Two seal retaining screws, one for each tab, are then inserted. The screws pass through the ram block, through the tab portion of the top seal located on the ram block face and into the face seal and its trunnion nuts. As the screws are tightened, the face seal and the top seal make contact and form a ram seal analogous to the prior art seal.

The seal of the present invention is comprised of two pieces, allowing the replacement of only the portions of the seal needing replacement, in addition to the previously mentioned ease of replacement. Additionally, the top seal is symmetric, allowing proper operation if installed upside down.

DESCRIPTION OF THE PREFERRED EMBODIMENT

Figure 1:
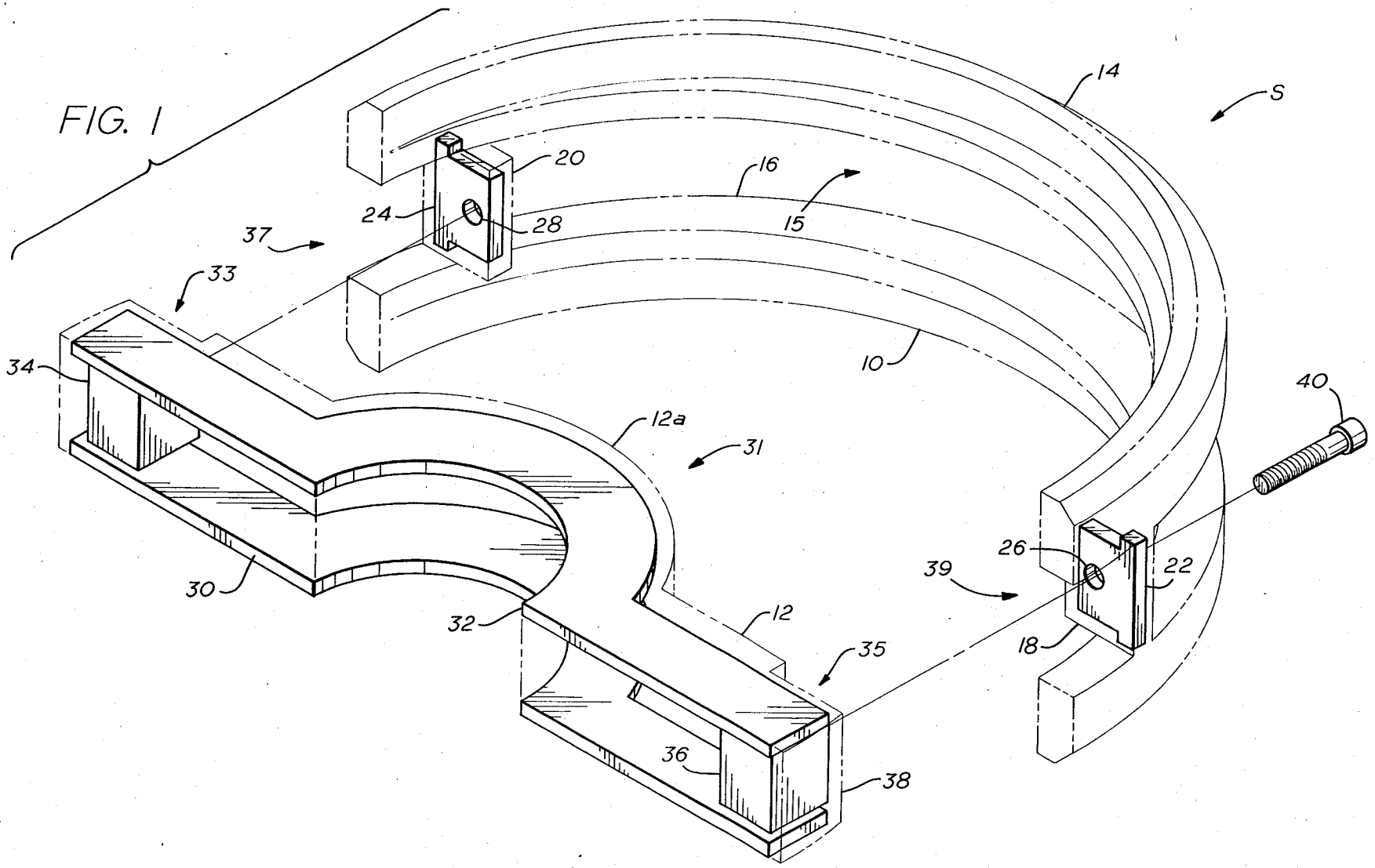
FIG. 1 is a perspective view of a ram seal according to the present invention illustrating the internal features of the invention.

Referring now to FIG. 1, the letter S generally represents a ram seal according to the present invention. The ram seal has two semi-annular portions, a top seal portion 10 and a face seal portion 12. The top seal 10 has an upper semi-annular portion 14, a lower semi-annular portion 16 and two tabs 18 and 20 which join together the upper and lower portions.

Each BOP has two ram blocks mounted in the BOP housing for movement inwardly toward each other for sealing engagement via the ram seals against each other and the drill pipe (not shown).

Figure 2:
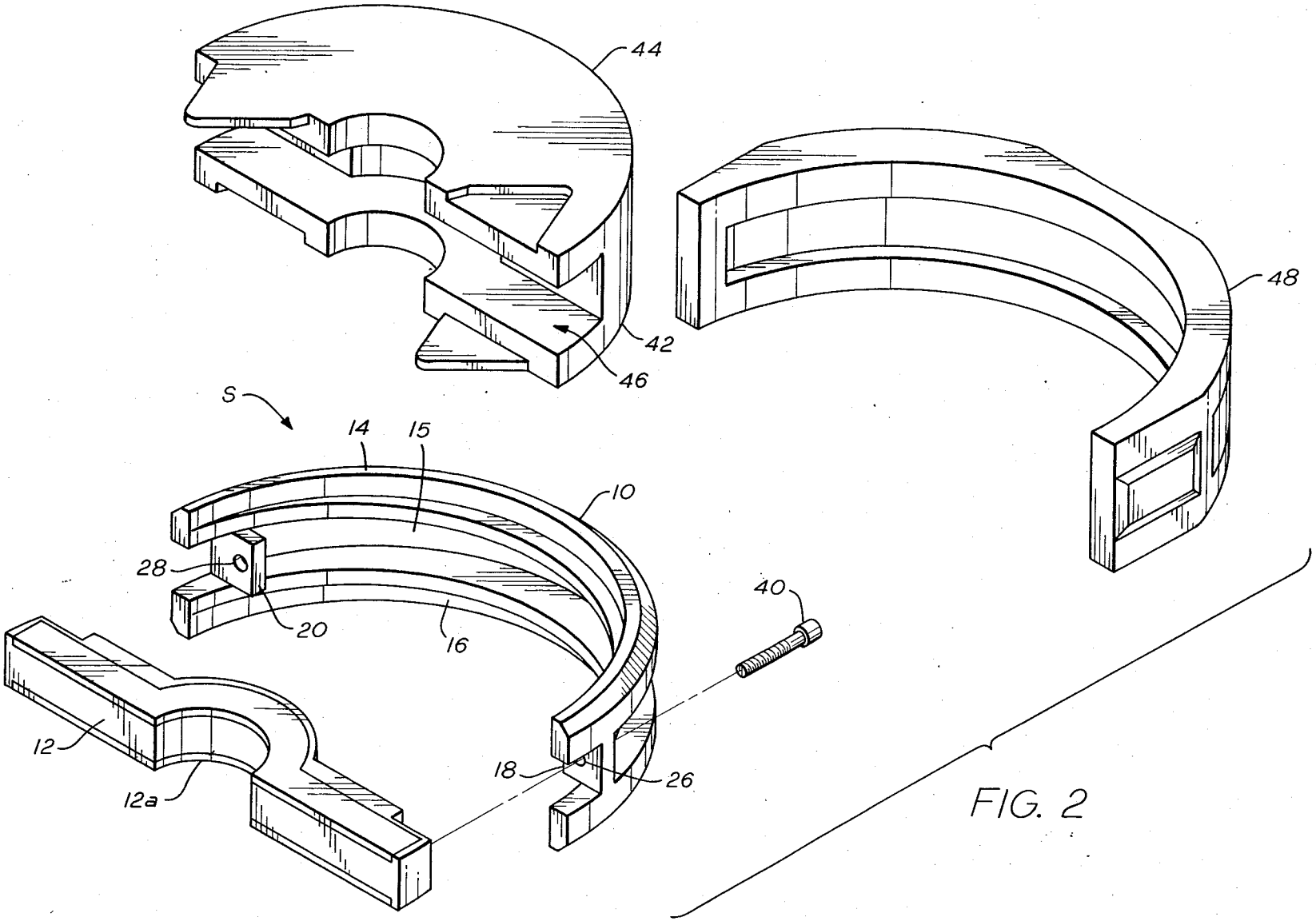
FIG. 2 is a perspective view of portions of a ram assembly including a ram seal according to the present invention.

There is a gap 15 between the upper portion 14 and the lower portion 16 arising because the upper portion 14 and the lower portion 16 are spaced longitudinally on the central axis of the semi-cylindrical ram block 42 (FIG. 2). This allows the ram seal S to better conform to the commercial embodiment of the prior art ram seal. The two tabs 18 and 20 have T-shaped metal inserts or plates 22 and 24 included therein. The metal inserts 22 and 24 are T-shaped to allow positive retention in the upper and lower portions 14 and 16 of the top seal 10 and to allow positive contact with the face of the ram block 42. Each metal insert 22 and 24 contains a hole 26 and 28, respectively, which hole is used in mounting to the ram block 42 (FIG. 2). The inserts 22 and 24 are not located at the ends of the semi-circular upper and lower portions 14 and 16, but are located an amount in from the ends. This inward mounting produces two top seal slots 37 and 39. The top seal 10 is generally comprised of a rubber material with the exception of the metal inserts 22 and 24 but may be made of other suitable resilient materials.

The face seal 12 is generally elongate but includes a central semi-annular section 12*a* adapted to seal about one-half of the drill pipe when the rams of the BOP are closed. The face seal 12 is generally comprised of rubber or other resilient material but has several metal plates contained therein. The face seal 12 contains extrusion plates 30 and 32 bonded to rubber portion 38 of the face seal 12 which are used to provide the self-feeding action of the rubber material which forms the seal. Each extrusion plate is generally elongated but includes a semi-annular section to conform to the shape of the face seal. Located near the ends of the extrusion plates 30 and 32 are trunnion nuts 34 and 36. These trunnion nuts 34 and 36, which are rectangular blocks, serve the two purposes of physically separating the extrusion plates 30 and 32 to provide the necessary thickness of the face seal 12 and of mating with retaining screws 40 to allow connection of the face seal 12 to the ram block 42 by containing threaded holes (not shown). The rubber portion 38 of the face seal 12 extends beyond the lateral ends of the extrusion plates 30 and 32 and forms an essentially continuous seal with the top seal slots 37 and 39. The rubber portion 38 contains two notches 33 and 35 at the ends on the rear surface 31 which mate with the tabs 18 and 20. The notches 33 and 35 allow the tabs 18 and 20 and the face seal 12 to have an even surface adjoining the ram block 42.

The retaining screws 40, one for each side of the ram seal S, are used to connect the top seal 10 and the face seal 12 together and to the ram block 42. This connection is made by having the retaining screw 40 pass through the ram block 42, through a tab hole 26 and thread into the trunnion nut 36, for example. In this way the two seal portions are restrained together and to the ram block 42.

The ram seal S is easily assembled or replaced on the ram block 42. The ram block 42 is a semicircular disk and is of a floating design. The floating design does not require an interference fit between the top seal and the BOP body until the ram is closed. The final top seal is affected by the well pressure. The top seal 10 is straightened and applied to the semi-circular surface 44 of the ram block 42. The tabs 18 and 20 of the top seal 10 are then placed in the face groove 46 of the ram block 42, allowing the tabs 18 and 20 to retain the top seal during installation and during use.

After the top seal 10 has been installed on the ram block 42, the face seal 12 is inserted into the face groove 46 and the retaining screws 40 are installed. Tightening the retaining screws 40 causes the face seal 12 to mate with the tabs 18 and 20 and the top seal slots 37 and 39, forming a tight seal and not allowing movement between the two portions. Tightening the retaining screws 40 also compresses the rubber of the seal portions against the ram block 42, thereby resisting movement of the ram seal S with respect to the ram block 42. After the retaining screws 40 have been properly tightened, the assembly of the ram block 42 is complete and is placed in the ram holder 48. The ram holder 48 connects to the other portions of the ram and the BOP, such as the hydraulic extension cylinders which are used to operate the rams.

Disassembly of the ram is done in the reverse order of assembly. The ram block 42 is removed from the holder 48, the retaining screws 40 are removed, the face seal 12 is removed and the top seal 10 is removed.

Because the top seal 10 and the face seal 12 are separate pieces, they can be replaced separately. This separation allows only the portion of the ram seal S needing replacement to be changed out, not the entire ram seal as required in the prior art reversible ram seal design. This design reduces the cost of operation because generally the face seal 12 section wears out rapidly and needs more frequent replacement, whereas the top seal 10 section wears out at a slower rate.

The face seal 12 can be configured for a pipe ram as shown in the figures, or for a blind ram, wherein the face seal 12 is a straight piece, without the semi-circular section used to mate with the pipe.

As illustrated, the face seal 12 and the top seal 10 are reversible, allowing a ram block 42 with a ram seal S to be installed upside down without affecting ram sealing.

The foregoing disclosure and description of the invention are illustrative and explanatory thereof, and various changes in the size, shape and materials as well as in the details of the illustrated construction may be made without departing from the spirit of the invention, all such changes being contemplated to fall within the scope of the appended claims.

I claim:

1. A blowout preventor ram seal for a blowout preventor having a semi-cylindrical ram block, comprising:

reversible top seal means;

reversible face seal means which is a separate element from the top seal means; and wherein said reversible top seal means and said reversible face seal means include mount means for mounting said top seal means and said face seal means onto said semi-cylindrical ram block in attachment to the ram block and to each other, said mount means including means allowing replacement of each of either said top seal means or said face seal means.

2. The seal of claim 1, wherein the face seal means comprises a generally elongate rubber seal portion, upper and lower extrusion plates conforming to the shape of said rubber seal portion and bonded to said rubber seal portion and at least two trunnion nuts embedded in said rubber seal portion.

3. The seal of claim 1, wherein the top seal means comprises a semi-annular rubber seal portion and at least two metal inserts located near the ends of said rubber seal portion and projecting inwardly.

4. The seal of claim 3, wherein the face seal means comprises a generally elongate rubber seal portion, upper and lower extrusion plates conforming to the shape of said rubber seal portion and bonded to said rubber seal portion and at least two trunnion nuts embedded in said rubber seal portion.

5. The seal of claim 4, wherein the top seal means semi-annular rubber seal portion comprises an upper portion and a lower portion spaced apart longitudinally along the central axis of said semi-cylindrical ram block.

6. The seal of claim 3, wherein the metal inserts are T-shaped and extend over a portion of the face of the ram block.

7. The seal of claim 1, wherein the face seal means includes a semi-annular section adapted to seal about one-half of a drill pipe.

8. A blowout preventer ram seal for a blowout preventer having an axially reversible, semi-cylindrical ram block and a corresponding ram block holder, comprising:

reversible top seal means, including a pair of axially spaced, semi-annular rubber seal portions and a pair of inwardly projecting, rubber-coated metal inserts, the inserts being coupled into the axially spaced seal portions near the ends of said seal portions to provide axial spacing of said seal portions and to extend over a portions of the ram block diametrical face when said top seal means is located on the ram block;

reversible face seal means which is a separats element from the top seal means, including a generally elongate rubber seal portion for mating with the diametrical face of the ram block and the top seal means inserts, upper and lower extrusion plates conforming to the shape of said face seal means rubber seal portion and bonded to said face seal means rubber seal portion, and spacing means located at the ends of said face seal means rubber seal portion for axially spacing said extrusion places; and wherein said reversible top seal means inserts and said reversible face seal means spacing means include means for allowing said top seal means and said face seal means to be mounted to the ram block, and to each other, said mount means being adapted to allow the replacement of either of said top seal means or said face seal means.

9. The ram seal of claim 8, wherein:

said top seal means inserts are T-shaped, with the top portions of the T being coupled with the top seal means rubber seal portions and the lower portion of the T projects inwardly and has a hole located to allow the passage of a bolt for mounting purposes; and said face seal means spacing means are trunnion nuts adapted so that the threaded cavity is located adjacent the top seal means insert holes when said top seal means and said face seal means are mounted on the ram block.

* * * * *

UNITED STATES PATENT AND TRADEMARK OFFICE

CERTIFICATE OF CORRECTION

PATENT NO. : 4,703,938

DATED : Nov. 3, 1987

INVENTOR(S) : Allan J. Fox

It is certified that error appears in the above-identified patent and that said Letters Patent is hereby corrected as shown below:

In col. 4, line 43, please change "of each of either" to -- of either of --.

In col. 5, line 17, please change "separats" to -- separate --.

Signed and Sealed this

Twenty-second Day of March, 1988

*Attest:*

DONALD J. QUIGG

*Attesting Officer*

*Commissioner of Patents and Trademarks*